US008776470B2

(12) United States Patent
Karam et al.

(10) Patent No.: US 8,776,470 B2
(45) Date of Patent: Jul. 15, 2014

(54) WALL REPAIR APPARATUS, SYSTEM, AND METHOD

(76) Inventors: Ted J. Karam, El Paso, TX (US); Jason Rubio, Grapevine, TX (US); Stephen Withers, Mansfield, TX (US)

( * ) Notice: Subject to any disclaimer, the term of this patent is extended or adjusted under 35 U.S.C. 154(b) by 67 days.

(21) Appl. No.: 13/107,050

(22) Filed: May 13, 2011

(65) Prior Publication Data

US 2011/0277412 A1 Nov. 17, 2011

Related U.S. Application Data

(60) Provisional application No. 61/334,852, filed on May 14, 2010.

(51) Int. Cl.
*E02D 37/00* (2006.01)

(52) U.S. Cl.
USPC ..... 52/514; 52/514.5

(58) Field of Classification Search
USPC ..... 52/514, 514.5, 127.2, 127.5
See application file for complete search history.

(56) References Cited

U.S. PATENT DOCUMENTS

| | | | | | |
|---|---|---|---|---|---|
| 2,638,774 | A * | 5/1953 | Wieman | 52/514 |
| 3,690,084 | A * | 9/1972 | Leblanc | 52/514 |
| 3,880,394 | A * | 4/1975 | Wisecarver | 248/354.3 |
| 3,936,988 | A * | 2/1976 | Miceli | 52/514 |
| 4,406,107 | A * | 9/1983 | Schoonbeck | 52/514 |
| 4,848,056 | A * | 7/1989 | Kelly | 52/514 |
| 4,930,281 | A * | 6/1990 | Martin et al. | 52/514 |
| 4,945,700 | A * | 8/1990 | Powell | 52/514 |
| 5,033,949 | A * | 7/1991 | Jewett | 425/12 |
| 5,048,796 | A * | 9/1991 | Maldonado | 254/100 |
| 5,117,605 | A * | 6/1992 | Waldbeiser | 52/514 |
| 5,353,568 | A | 10/1994 | Silva | |
| 6,023,901 | A | 2/2000 | Jensen | |
| 7,121,054 | B2 * | 10/2006 | Shock | 52/514.5 |
| 2006/0010817 | A1 | 1/2006 | Shull | |
| 2006/0096220 | A1 | 5/2006 | Greer et al. | |
| 2006/0123728 | A1 | 6/2006 | Clark | |
| 2007/0125035 | A1 | 6/2007 | Herbold | |
| 2008/0083185 | A1 | 4/2008 | Lin | |
| 2008/0229694 | A1 | 9/2008 | Ising | |
| 2011/0056160 | A1 | 3/2011 | Barry | |

* cited by examiner

*Primary Examiner* — Basil Katcheves
(74) *Attorney, Agent, or Firm* — Melissa Silverstein; Luis M. Ortiz; Kermit D. Lopez

(57) ABSTRACT

A wall repair apparatus, system, and method to repair localized wall damage and easily support an installed wall repair patch are disclosed. The disclosed embodiments provide a convenient way to both position and align a wall repair patch with the outer face of the wall surface and support it in place from within the wall cavity. The wall repair apparatus supports and reinforces a wall repair patch to prevent the wall repair patch from moving within a repaired wall, thus causing further damage. The wall repair apparatus comprises a female interlocking member and a male interlocking member that are appropriately sized to securely fit inside of a wall cavity, behind a wall repair patch. A male interlocking member with annular rings is sized to fit within a female interlocking member to form a tension-fitted wall repair apparatus that spans a wall cavity and supports a wall repair patch.

17 Claims, 5 Drawing Sheets

WALL REPAIR APPARATUS, SYSTEM, AND METHOD

CROSS REFERENCE TO RELATED APPLICATIONS

This patent application claims the benefit under 35 U.S.C. §119(e) of U.S. Provisional Patent Application Ser. No. 61/334,852 filed on May 14, 2010, and entitled "Drywall Repair System and Method," which is hereby incorporated by reference in its entirety.

TECHNICAL FIELD

The disclosed embodiments relate to repairing walls. The disclosed embodiments further relate to installing a wall repair patch. The disclosed embodiments also relate to a wall repair apparatus to support an installed wall patch within a repaired wall.

BACKGROUND OF THE INVENTION

Walls of building structures typically comprise a structural frame with attached wall surfaces. Exterior walls often comprise insulation, an exterior wall surface, and an interior wall surface. Interior walls typically comprise two interior wall surfaces with a hollow wall cavity formed in between the first and second interior wall surface. Interior walls are typically formed of parallel board-like materials attached to framing or studs. The board-like materials are typically spaced apart at a particular distance to cover the skeletal framing members and accommodate components within the wall cavity such as, for example, insulation, plumbing, electrical wires, etc.

Board-like materials can include drywall, gypsum board, Sheetrock®, plasterboard, sheathing, etc. Drywall, also commonly referred to as wall board or gypsum panel, is often used in homes, buildings, and other structures. Drywall is essentially chalk-like gypsum pressed between layers of paperboard. Typically, sheets of drywall are nailed or screwed to a structure's framing with a plurality of sheets "hung" next to each other in an abutted fashion to form a wall. Installed drywall panels provide a flat wall or ceiling surface which spans supporting members, leaving the space between the studs or joists hollow behind the wall surface. The gaps between the drywall sheets can be filled with joint compound or vinyl spackling commonly referred to as "mud" or "spackle". When the spackle dries and hardens, the surface may be sanded and painted to provide a finished look. The dried spackle; however, has relatively little structural integrity and primarily provides a cosmetic benefit of a smooth wall or ceiling surface.

While drywall provides an aesthetically pleasing look, it is easily damaged when it is struck by an object such as, for example, a doorknob, piece of furniture, or a fist, and often needs repair. In addition, holes may be formed in drywall material when performing repairs or maintenance of mechanical systems, plumbing, or electrical wiring within the wall cavity. Removal or relocation of an electrical outlet or switch box during remodeling may leave a hole in the wall that must be filled or covered. Localized damage to a wall also occurs from installation or removal of nails, picture mounts, and light fixtures. The damaged portion of a drywall panel may range in size from a very small area to a large hole. Removing an entire drywall panel to repair damaged portions is difficult, expensive, and may cause damage to unseen structures within the wall cavity.

Whether formed by accident or intentionally, localized holes in drywall material are often patched. No convenient way exists to both position a wall patch flush with the outer face of the wall surface and support it in place. When using only a replacement drywall patch without any support for that patch, the drywall patch may fall into the hollow wall cavity, therefore resulting in unsightly cracks and a disfigured wall surface. It can also be difficult to reinforce a repaired drywall patch to prevent future damage from objects that strike the wall. Material for support, such as wire mesh, newspaper, or cloth-like material can be bunched up and added behind the drywall repair patch in the hollow wall cavity. The drywall patch, however, can detach from the rest of the drywall panel when the bundled support becomes dislodged within the wall cavity. The repair patch can also dislodge should anything hit the repair patch without some sort of supporting structure remaining behind the repaired patch within the wall cavity. Such a supporting structure needs to receive and rebuff any direct or indirect pressure on the drywall repair patch to prevent the patch from moving and causing additional damage in the repaired wall.

Accordingly, there exists a need for an improved wall repair apparatus, system, and method to easily and effectively repair a damaged wall while providing a bracing support within the wall cavity.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is therefore an object of the disclosed embodiments to provide an improved wall repair apparatus, system, and method.

It is another object of the disclosed embodiments to align and support a wall repair patch.

It is an additional object of the disclosed embodiments to brace an installed wall repair patch from within a wall cavity to prevent further wall damage.

The above and other aspects can be achieved as is now described. A wall repair apparatus, system, and method to repair localized wall damage and easily support an installed wall repair patch are disclosed. The disclosed embodiments provide a convenient way to both position and align a wall repair patch with the outer face of the wall surface and support it in place from within the wall cavity. The wall repair apparatus supports and reinforces a wall repair patch to prevent the wall repair patch from moving within a repaired wall, thus causing further damage. The wall repair apparatus comprises a female interlocking member and a male interlocking member that are appropriately sized to securely fit inside of a wall cavity, behind a wall repair patch. A male interlocking member with annular rings is sized to fit within a female interlocking member to form a tension-fitted wall repair apparatus that spans a wall cavity and supports a wall repair patch.

A wall repair apparatus is disclosed that comprises a female interlocking member comprising a female base plate and a tube extending perpendicularly from said female base plate; and a male interlocking member comprising a male base plate and a rod extending perpendicularly from said male base plate wherein said tube of said female interlocking member receives and grips said rod of said male interlocking member to form said wall repair apparatus, wherein said wall repair apparatus spans a wall cavity and supports a wall repair patch. The apparatus further comprises at least one annular ring surrounding and extending from said rod of said male interlocking member wherein said at least one annular ring is sized to interlock with an interior surface of said female interlocking member via a tension fit. The apparatus further comprises a plurality of annular rings surrounding and extending from said rod of said male interlocking member wherein said plurality of annular rings are sized to interlock an interior surface of said female interlocking member. The plurality of annular rings can be evenly spaced along a length of said rod of said male interlocking member. The plurality of annular rings can also be spaced along a length of said rod of said male interlocking member in gradually increasing intervals, wherein said plurality of annular rings are spaced further apart as said plurality of annular rings approach said male base plate, wherein said plurality of annular rings extend along a length of said rod of said male interlocking member.

The apparatus further comprises tapered joints connecting said female base plate and said tube extending perpendicularly from said female base plate, and said male base plate and said rod extending perpendicularly from said male base plate wherein said tapered joint provides strength and stability to said wall repair apparatus. The female base plate and male base plate can comprise at least one of the following shapes: a square, rectangle, circle, oval, diamond, star, and triangle. Said female base plate can be covered with an adhesive composition, at least one prong, at least one screw, or at least one nail to adhere said female base plate to said wall repair patch or a surface of an interior wall exposed to said wall cavity. Said male base plate can be covered with an adhesive composition, at least one prong, at least one screw, or at least one nail to adhere said male base plate to said wall repair patch or a surface of an interior wall exposed to the said wall cavity.

A wall repair system is also disclosed. The wall repair system comprises a female interlocking member comprising a female base plate and a tube extending perpendicularly from said female base plate; a male interlocking member comprising a male base plate and a rod extending perpendicularly from said male base plate wherein said tube of said female interlocking member receives and grips said rod of said male interlocking member to form said wall repair apparatus; and a wall repair patch inserted within a wall cavity with an appropriately sized said wall repair apparatus attached to said wall repair patch, wherein said attached wall repair apparatus attaches to an interior surface of a wall facing said wall cavity, wherein said wall repair apparatus spans said wall cavity and supports said wall repair patch. The system further comprises at least one annular ring surrounding and extending from said rod of said male interlocking member wherein said at least one annular ring is sized to interlock with an interior surface of said female interlocking member via a tension fit. The system also comprises a plurality of annular rings surrounding and extending from said rod of said male interlocking member wherein said plurality of annular rings are sized to interlock an interior surface of said female interlocking member via a tension fit. The plurality of annular rings can be evenly spaced along a length of said rod of said male interlocking member. The plurality of annular rings can be spaced along a length of said rod of said male interlocking member in gradually increasing intervals, wherein said plurality of annular rings are spaced further apart as said plurality of annular rings approach said male base plate, wherein said plurality of annular rings extend along a length of said rod of said male interlocking member.

The system further comprises a tapered joint connecting said female base plate and said tube extending perpendicularly from said female base plate wherein said tapered joint provides strength and stability to said wall repair apparatus; and a tapered joint connecting said male base plate and said rod extending perpendicularly from said male base plate wherein said tapered joint provides strength and stability to said wall repair apparatus. Said female base plate can be covered with an adhesive composition, at least one prong, at least one screw, or at least one nail to adhere said female base plate to said wall repair patch or a surface of an interior wall exposed to said wall cavity; and said male base plate is covered with an adhesive composition, at least one prong, at least one screw, or at least one nail to adhere said male base plate to said wall repair patch or a surface of an interior wall exposed to the said wall cavity.

A wall repair method is disclosed that comprises utilizing a female interlocking member comprising a female base plate and a tube extending perpendicularly from said female base plate; utilizing a male interlocking member comprising a male base plate and a rod extending from said male base plate, wherein said rod is surrounded by at least one annular ring; and receiving said male interlocking member within said female interlocking member to form a tension-fitted wall repair apparatus that spans a wall cavity and supports a wall repair patch. The method further comprises adhering said female base plate using an adhesive composition, at least one prong, at least one screw, or at least one nail to either said wall repair patch or an interior surface of a wall facing said wall cavity; and adhering said male base plate using an adhesive composition, at least one prong, at least one screw, or at least one nail to either said wall repair patch or said interior surface of said wall facing said wall cavity. The method further comprises adjusting said female interlocking member and said male interlocking member by pulling said rod of said male interlocking member from within said tube of said female interlocking member to expose at least one annular ring surrounding said rod of said male interlocking member to fit said wall repair apparatus within said wall cavity. The method further comprises aligning said wall repair patch with said attached said wall repair apparatus with a wall surface to repair a damaged portion of said wall surface; spackling around said wall repair patch; sanding said spackling smooth around said wall repair patch when said spackle dries; and painting said wall repair patch to match said wall surface.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
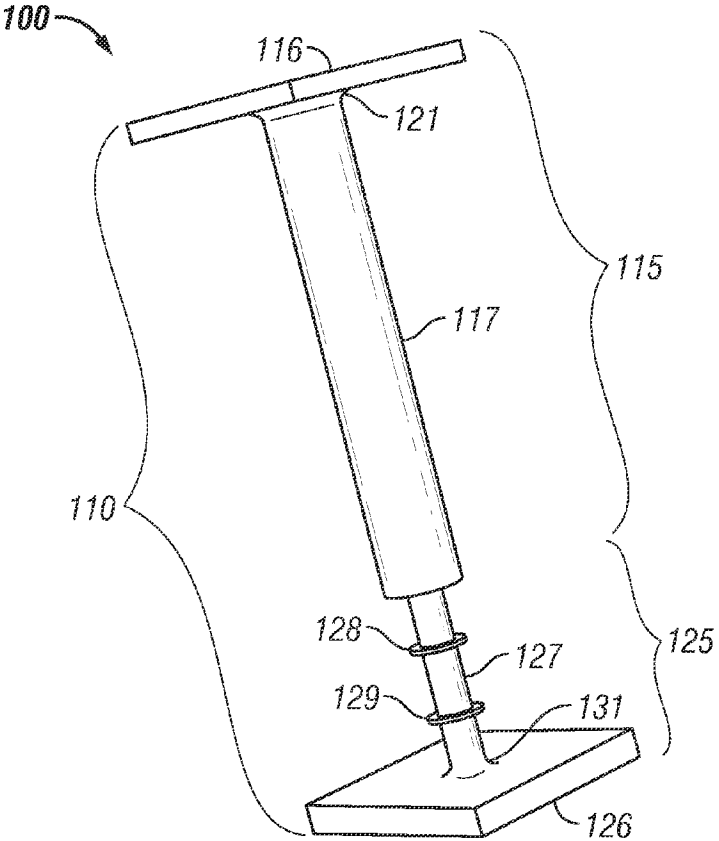
FIG. 1 illustrates a front perspective view of a wall repair apparatus, in accordance with the disclosed embodiments.

FIG. 1 illustrates a front perspective view 100 of a wall repair apparatus 110, in accordance with the disclosed embodiments. The disclosed apparatus, system, and method allow a user to repair localized wall damage and easily support an installed wall repair patch. The disclosed wall repair apparatus 110, also known as a drywall repair support tool or a wall patch support, reinforces a wall repair patch to prevent the wall repair patch from moving and further damaging a repaired wall. The wall repair apparatus 110 can be constructed out of a variety of materials such as, for example, a variety of polymers to create a stiff, yet pliant wall repair apparatus 110. This wall repair apparatus 110 comprises a female interlocking member 115 (e.g., first interlocking member) and a male interlocking member 125 (e.g., second interlocking member) that are appropriately sized to securely fit inside of a wall cavity, behind a wall repair patch. It is understood that the terms "first interlocking member" in relation to the female interlocking member 115 and "second interlocking member" in relation to the male interlocking member 125 are arbitrary assignments of terminology and not intended to limit the embodiments to that particular terminology. In an alternate embodiment, the female interlocking member could be interchangeably referred to as a second interlocking member and the male interlocking member could be referred to as a first interlocking member.

The female interlocking member 115 comprises a female base plate 116 and a tube 117 that extends perpendicularly from the female base plate 116. The tube 117 that perpendicularly extends from female base plate 116 is attached to the female base plate 116 via a tapered joint 121 to lend strength and stability to the wall repair apparatus 110. The male interlocking member 125 comprises a male base plate 126 and a rod 127 that extends perpendicularly from the center of the male base plate 126. The rod 127 that perpendicularly extends from male base plate 126 is attached to the male base plate 126 via a tapered joint 131 to lend strength and stability to the wall repair apparatus 110. The female base plate 116 and the male base plate 126 are depicted in FIGS. 1-6 as squares. The female base plate 116 and male base plate 126 are not limited to a square shape. The base plates could be any combination of shapes, such as, for, example, a square, a rectangle, a circle, an oval, a diamond, a star, a triangle, or other shaped base plate. For example, FIGS. 7-10 depict circular base plates 316, 326 as exemplary embodiments of the disclosed wall repair apparatus 110.

Figure 6:
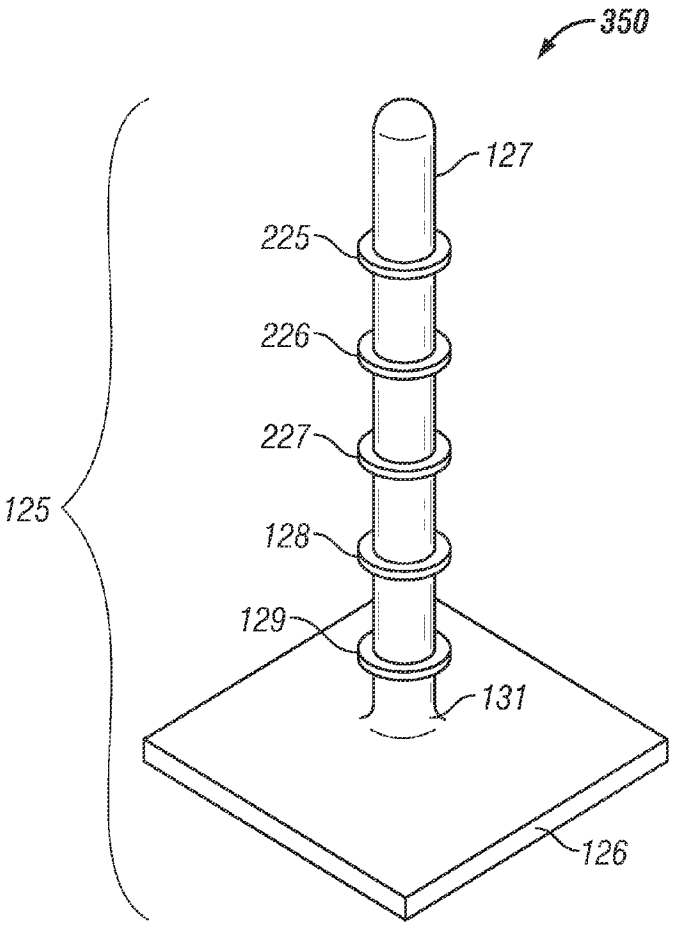
FIG. 6 illustrates a top perspective view of a male interlocking member of the wall repair apparatus, in accordance with the disclosed embodiments.

The tube 117 that extends from the female base plate 116 is appropriately sized to receive annular rings 128, 129 surrounding the rod 127 of the male interlocking member 125. The annular rings 128, 129 are spaced along the entire length of the rod 127 of the male interlocking member 125 (as illustrated in FIG. 6). The annular rings 128, 129 can be evenly spaced apart along the length of the rod 127 or spaced in any number or combination of distances to account for variously-sized wall cavities. The annular rings 128, 129 can gradually progress in size to allow for a tighter fit of the male interlocking member 125 within the female interlocking member 115 when the male interlocking member 125 is adjusted. The annular rings 128, 129 are sized to tightly fit within the interior surface of the tube 117 of the female interlocking member 115 when the male interlocking member 125 is inserted within the tube 117 of the female interlocking member 115. The annular rings 128, 129 allow the male interlocking member 125 to be adjusted to allow the wall repair apparatus 110 to span the width of a wall cavity, while tightly gripping the tube 117 of the female interlocking member 115. The annular rings 128, 129 can comprise the same material as the male interlocking member 125 or a different material to make the annular rings 128, 129 stiffer or more flexible to both tightly grip the female interlocking member 115 while allowing the male interlocking member 125 to be adjusted, as needed, to fit within a particular wall cavity. For example, a male interlocking member 125 can be pushed further into the female interlocking member 115, thus only exposing one annular ring 129 surrounding the rod 127. Therefore, the wall repair apparatus 110 could fit within a narrower wall cavity. Conversely, the male interlocking member 125 could be pulled further out of the female interlocking member 115 to expose a greater number of annular rings 225, 226, 227 (as illustrated in FIG. 6) to fit within a wider wall cavity.

Figure 2:
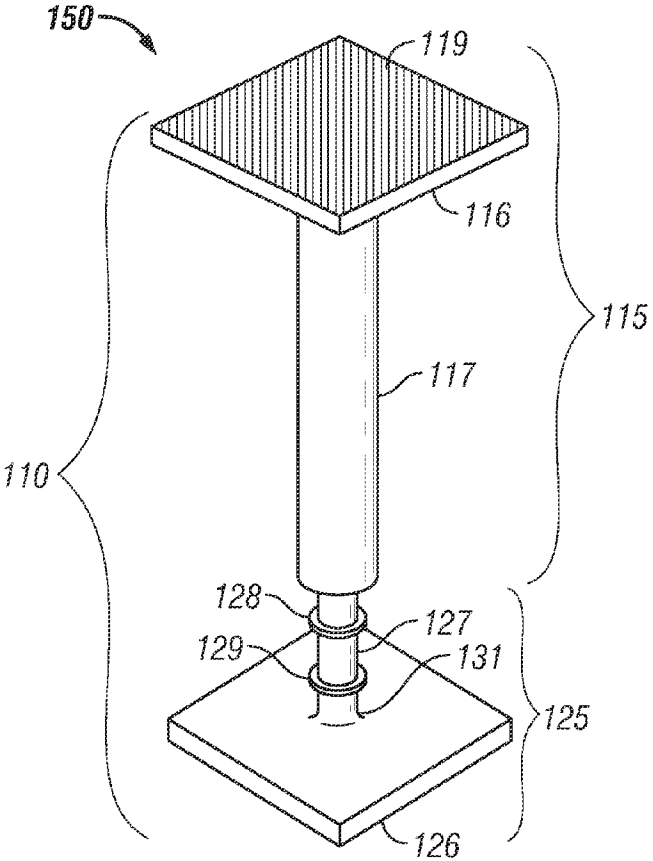
FIG. 2 illustrates a top perspective view of a wall repair apparatus, in accordance with the disclosed embodiments.

FIG. 2 illustrates a top perspective view 150 of a wall repair apparatus 110, in accordance with the disclosed embodiments. The underside of the female base plate 116 can be covered with a pressure-sensitive adhesive composition 119.

Figure 3:
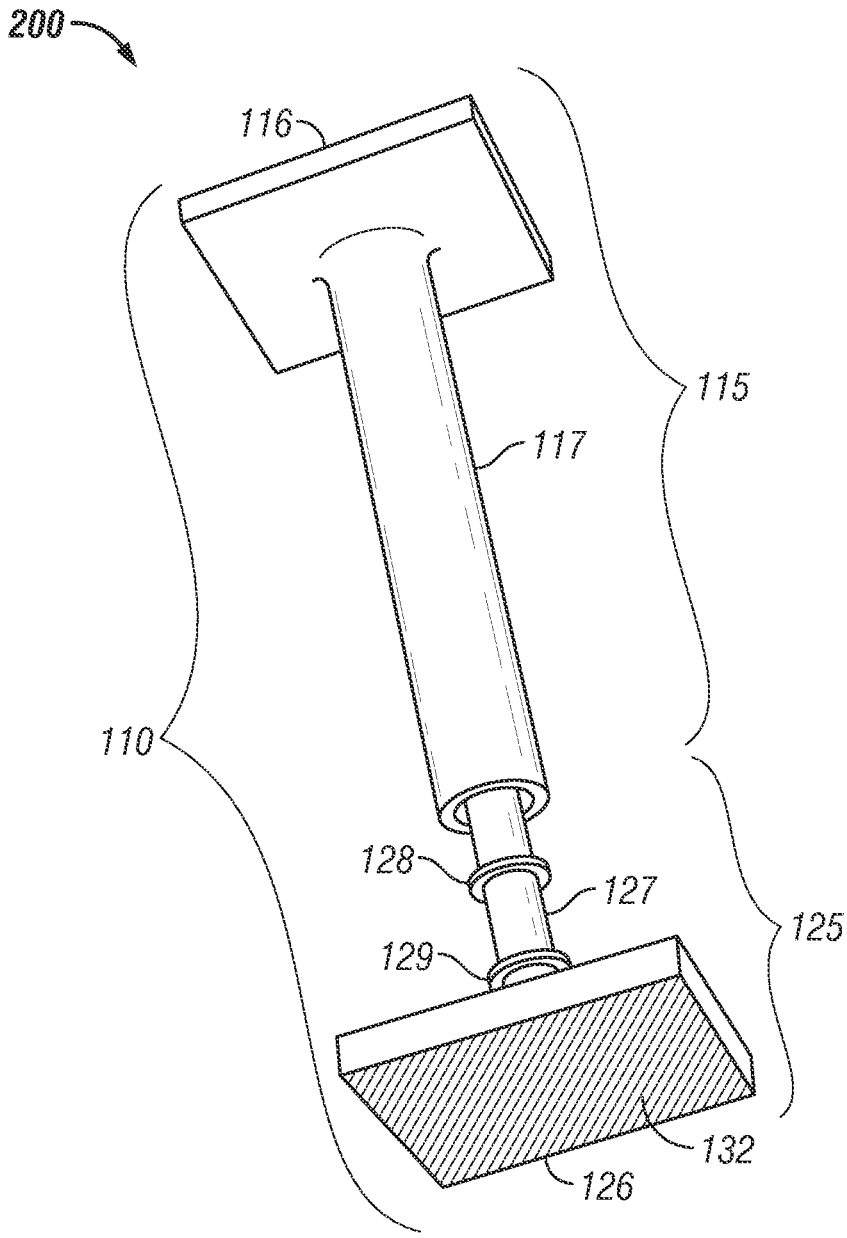
FIG. 3 illustrates a bottom perspective view of a wall repair apparatus, in accordance with the disclosed embodiments.

The adhesive composition 119 adheres the female base plate 116 to a wall repair patch or the surface of the interior wall exposed to the wall cavity. A protective paper can cover the adhesive composition 119 and can be removed to expose the adhesive composition 119 before the wall repair apparatus 110 is attached to a wall repair patch or to the surface of the interior wall exposed to the wall cavity. The underside of the male base plate 126 can also be covered with a pressure-sensitive adhesive composition 132 (as illustrated in FIG. 3). The adhesive composition 132 adheres the male base plate 116 to a wall repair patch. A protective paper can cover the adhesive composition 132 and can be removed to expose the adhesive composition 132 before the wall repair apparatus 110 is attached to a wall repair patch or to the surface of the interior wall exposed to the wall cavity. In an alternate embodiment, the underside of the female base plate 116 can be covered in at least one of a plurality of, or a combination of, an extending prong, nail, screw, or other type of spearing or gripping material (not illustrated) either in conjunction with the adhesive composition 119 or without the adhesive composition 119. In an alternate embodiment, the underside of the male base plate 126 can be covered in at least one of a plurality of, or a combination of, an extending prong, nail, screw, or other type of spearing or gripping material (not illustrated) either in conjunction with the adhesive composition 132 or without the adhesive composition 132.

Figure 4:
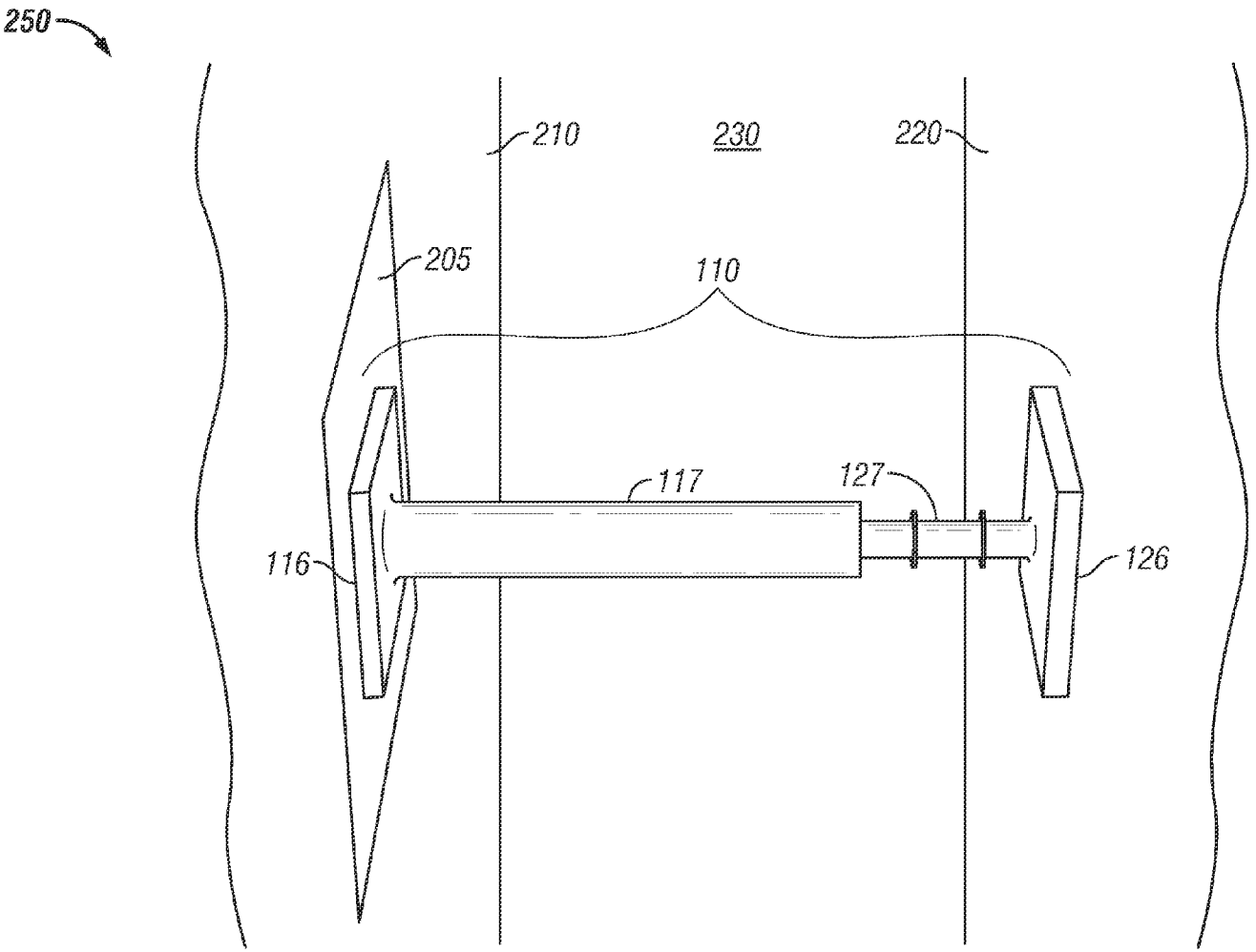
FIG. 4 illustrates a front perspective view of the wall repair apparatus installed within a wall cavity to support a wall patch, in accordance with the disclosed embodiments.

FIG. 4 illustrates a front perspective view 250 of a wall repair apparatus 110 installed within a wall cavity 230 to support a wall repair patch 205, in accordance with the disclosed embodiments. The wall repair patch 205 is sized to replace a damaged portion of wall 210. For example, a wall 210 is locally damaged from being struck by a doorknob, piece of furniture, or a fist, from performing repair or maintenance of mechanical systems such as plumbing or electrical wiring within the wall 210, from removal or relocation of an electrical outlet or switch box, or from installation or removal of nails, picture mounts, and light fixtures, etc. A user can remove a small portion of the wall 210 surrounding the localized damage. A wall repair patch 205 such as, for example, a drywall repair patch, can be sized to fit within the cut out portion of the wall 210. The wall repair apparatus 110 is appropriately sized to span the width of the wall cavity 230 while attaching to the wall patch 205 and the surface of the interior wall 220 exposed to the wall cavity 230. It is understood that FIG. 4 illustrates an exemplary embodiment where the female base plate 116 attaches to the wall repair patch 205 via an adhesive composition 119 and/or extending member, and the male base plate 126 attaches to the surface of the surface of the interior wall 220 exposed to the wall cavity 230 via an adhesive composition 132 and/or extending member. The wall repair apparatus 110 is not limited to this particular orientation; the female base plate 116 can attach to the surface of the interior wall 220 exposed to the wall cavity 230 and the male base plate 126 can attach to the wall repair patch 205.

The female base plate 116 is attached to the wall repair patch 205 in FIG. 4 as an exemplary embodiment. The wall repair patch 205 is then placed into position within the wall cavity 230 to allow the male base plate 126 to contact and attach to the surface of the interior wall 220. The planar face of the wall repair patch 205 is aligned with the surrounding wall 210. The wall repair apparatus 110 remains within the wall cavity 230, when installed behind the wall repair patch 205, to provide bracing and prevent future movement and/or wall 210 damage. Should a door knob hit the wall repair patch 205, for example, the wall repair apparatus 110 within the wall cavity 230 supports the wall repair patch 205 and prevents the wall repair patch 205 from moving, thus causing further damage to the wall 210. The wall 210 repair is finished by spackling around the wall repair patch 205 and sanding smooth once the spackle dries. The wall repair patch 205 can then be painted and textured to match the wall 210 surface.

For larger repairs or for repairing widely-damaged wall sections, a plurality of wall repair apparatuses 110 can be used in the same way as described in FIG. 4 to repair and support a larger wall repair patch 205. The user could also use a plurality of wall repair apparatuses 110 to align and support a wall repair patch 205 that straddles a stud and/or mechanical or electrical components within a wall cavity 230.

Figure 5:
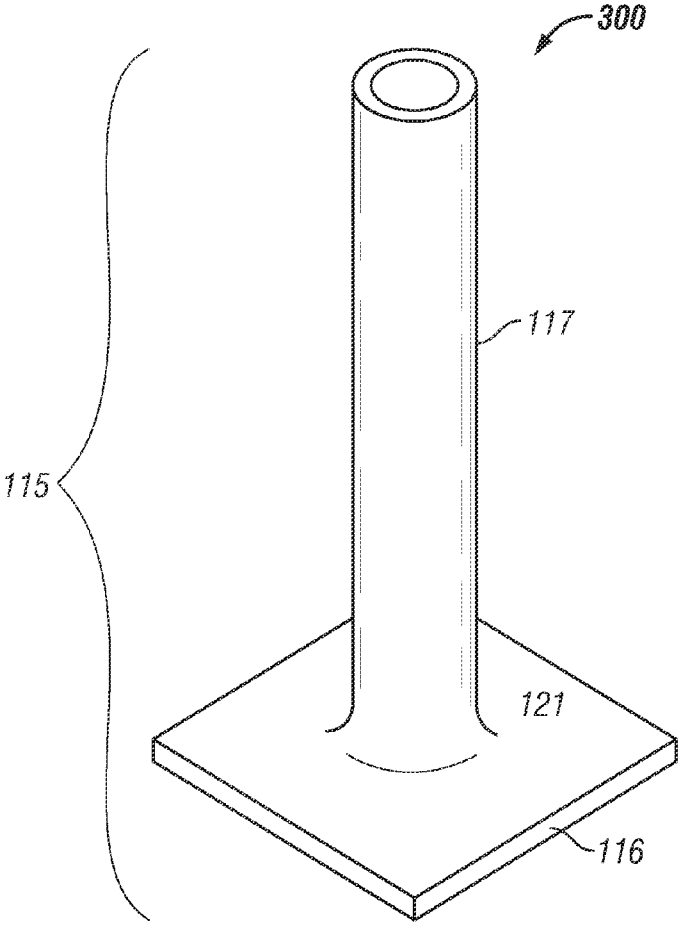
FIG. 5 illustrates a lop perspective view of a female interlocking member of the wall repair apparatus, in accordance with the disclosed embodiments.

FIG. 5 illustrates a top perspective view 300 of a female interlocking member 115 of the wall repair apparatus 110, in accordance with the disclosed embodiments. The female interlocking member 115 comprises a female base plate 116 and a tube 117 that extends perpendicularly from the female base plate 116. The tube 117 that perpendicularly extends from female base plate 116 is attached to the female base plate 116 via a tapered joint 121 to lend strength and stability to the wall repair apparatus 110.

FIG. 6 illustrates a top perspective view 350 of a male interlocking member 125 of the wall repair apparatus 110, in accordance with the disclosed embodiments. The male interlocking member 125 comprises a male base plate 126 and a rod 127 that extends perpendicularly from the center of the male base plate 126. The rod 117 that perpendicularly extends from male base plate 126 is attached to the male base plate 126 via a tapered joint 131 to lend strength and stability to the wall repair apparatus 110. A plurality of annular rings 129, 128, 227, 226, 225 extend along the entire length of the rod 127 of the male interlocking member 125. The annular rings 129, 128, 227, 226, 225 can be evenly spaced apart along the length of the rod 127 or spaced in any number of distances to account for variously-sized wall cavities. The annular rings 129, 128, 227, 226, 225 can comprise the same material as the male interlocking member 125 or a different material to make the annular rings stiffer or more flexible to both tightly grip the female interlocking member 115 while allowing the male interlocking member 125 to be adjusted as needed to fit within a particular wall cavity. The annular rings 129, 128, 227, 226, 225 can gradually progress in size to allow for a tighter fit of the male interlocking member 125 within the female interlocking member 115 when the male interlocking member 125 is adjusted.

Figure 7:
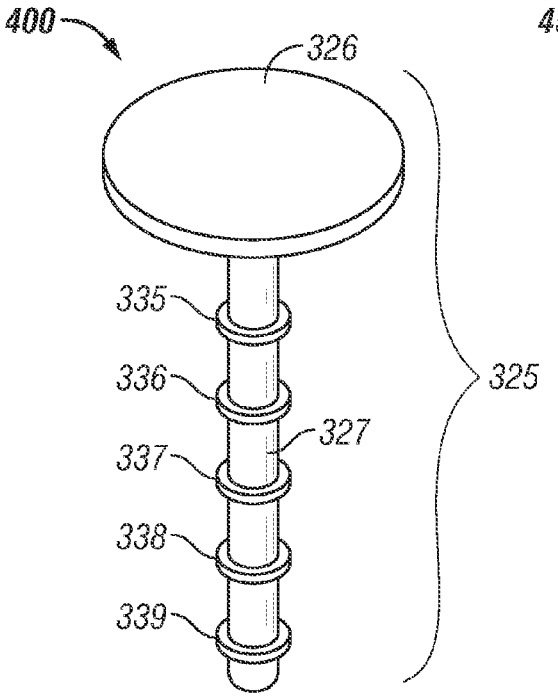
FIG. 7 illustrates a bottom perspective view of a male interlocking member of the wall repair apparatus, in accordance with the disclosed embodiments.
Figure 8:
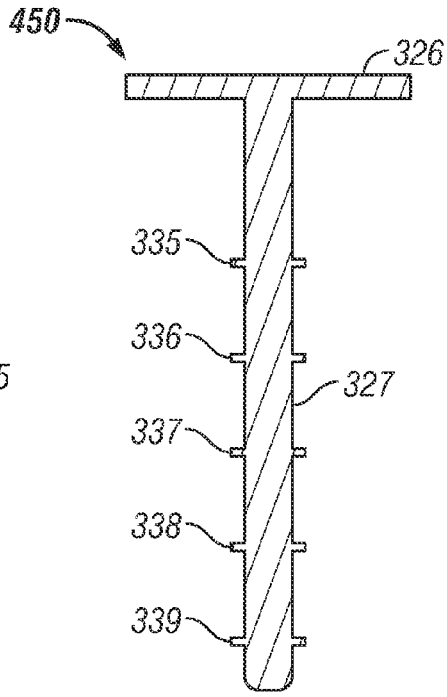
FIG. 8 illustrates a sectional view of a male interlocking member of the wall repair apparatus, in accordance with the disclosed embodiments.

FIG. 7 illustrates a bottom perspective view 400 of a male interlocking member 325 of the wall repair apparatus, in accordance with the disclosed embodiments. The male base plate 326 is depicted as a circular base plate. A plurality of annular rings 335, 336, 337, 338, 339 extend along the entire length of the rod 327 of the male interlocking member 325. FIG. 8 illustrates a sectional view 450 of a male interlocking member 325 of the wall repair apparatus, in accordance with the disclosed embodiments. The male base plate 326 is illustrated. A plurality of annular rings 335, 336, 337, 338, 339 extend along the entire length of the rod 327 of the male interlocking member 325.

Figure 9:
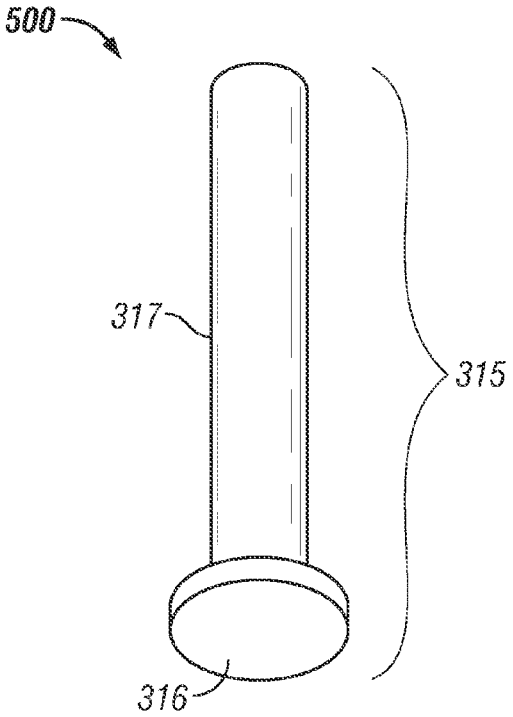
FIG. 9 illustrates a bottom perspective view of a female interlocking member of the wall repair apparatus, in accordance with the disclosed embodiments.
Figure 10:
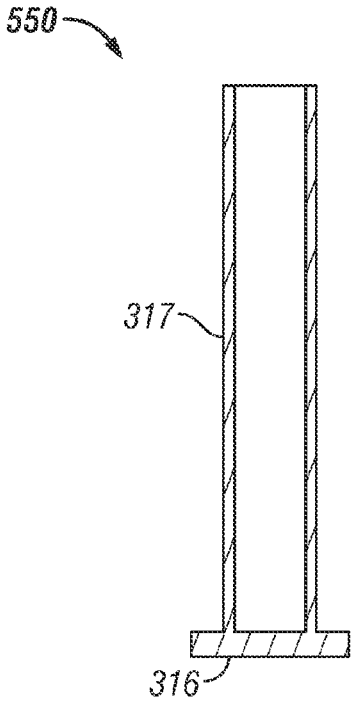
FIG. 10 illustrates a sectional view of a female interlocking member of the wall repair apparatus, in accordance with the disclosed embodiments.

FIG. 9 illustrates a bottom perspective view 500 of a female interlocking member 315 of the wall repair apparatus, in accordance with the disclosed embodiments. The female base plate 316 is depicted as a circular base plate. A tube 317 extends perpendicularly from the female base plate 316. FIG. 10 illustrates a sectional view 550 of a female interlocking member 315 of the wall repair apparatus, in accordance with the disclosed embodiments. The female base plate 316 is illustrated. A tube 317 extends perpendicularly from the female base plate 316. It is noted that FIGS. 1-10 are not illustrated to scale and are depicted as exemplary embodiments that could be sized using any combination of dimensions. The orientations of the embodiments in FIGS. 1-10 are not limited to the particular dimensions depicted within. The disclosed embodiments can also be produced in a wall repair kit comprising a wall repair apparatus 110, a pre-cut wall repair patch 205 such as, for example, a drywall patch, and any other items needed to repair a damaged wall.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A wall repair apparatus for spanning a wall cavity, said wall repair apparatus comprising:

a unitary one piece female interlocking member comprising a female base plate, wherein said female base plate has a first flat surface, a second flat surface, a first perimeter, and a hollow tube extending perpendicularly from said second flat surface wherein said first perimeter is greater than a diameter of said hollow tube; a unitary one piece adjustable male interlocking member comprising a male base plate, wherein said male base plate has a third flat surface, a fourth flat surface, a second perimeter, wherein said first perimeter and said second perimeter are a same size, and a rod extending perpendicularly from said third flat surface, wherein said hollow tube of said female interlocking member receives and grips said rod of said male interlocking member thus forming said wall repair apparatus; and a plurality of spaced annular rings surrounding and extending from said rod of said male interlocking member, wherein a gap exists between each of said spaced annular rings, wherein said plurality of spaced annular rings are sized to contact and interlock within an interior surface of said female interlocking member via a tension fit when said male interlocking member is adjusted within said female interlocking member.

2. The apparatus of claim 1 wherein said plurality of annular rings are evenly spaced along a length of said rod of said male interlocking member.

3. The apparatus of claim 1 further comprising a tapered joint connecting said female base plate and said tube extending perpendicularly from said female base plate wherein said tapered joint provides strength and stability to said wall repair apparatus.

4. The apparatus of claim 1 further comprising a tapered joint connecting said male base plate and said rod extending perpendicularly from said male base plate wherein said tapered joint provides strength and stability to said wall repair apparatus.

5. The apparatus of claim 1 wherein:

said female base plate comprises at least one of the following shapes: a square, rectangle, circle, oval, diamond, star, and triangle; and said male base plate comprises at least one of the following shapes: a square, rectangle, circle, oval, diamond, star, and triangle.

6. The apparatus of claim 1 wherein:

said female base plate is covered with an adhesive composition, at least one prong, at least one screw, or at least one nail to adhere said female base plate to a wall repair patch or a surface of an interior wall exposed to said wall cavity; and said male base plate is covered with an adhesive composition, at least one prong, at least one screw, or at least one nail to adhere said male base plate to a wall repair patch or a surface of an interior wall exposed to the said wall cavity.

7. The apparatus of claim 6 wherein said adhesive composition is covered by a removable protective paper, wherein said removable protective paper is removed to expose said adhesive composition.

8. A wall repair system for spanning two pieces of drywall, said wall repair system comprising:

a unitary one piece female interlocking member comprising a female base plate, wherein said female base plate has a first flat surface, a second flat surface, a first perimeter, and a hollow tube extending perpendicularly from said second flat surface wherein said first perimeter is greater than a diameter of said hollow tube; a unitary one piece adjustable male interlocking member comprising a male base plate, wherein said male base plate has a third flat surface, a fourth flat surface, a second perimeter, wherein said first perimeter and said second perimeter are a same size, and a rod extending perpendicularly from said third flat surface, wherein said hollow tube of said female interlocking member receives and grips said rod of said male interlocking member thus forming said wall repair apparatus;

a plurality of spaced annular rings surrounding and extending from said rod of said male interlocking member, wherein a gap exists between each of said spaced annular rings, wherein said plurality of spaced annular rings are sized to contact and interlock within an interior surface of said female interlocking member via a tension fit when said male interlocking member is adjusted within said female interlocking member; and a wall cavity between said two pieces of drywall with an appropriately sized said wall repair apparatus attached to said two pieces of drywall, wherein said attached said wall repair apparatus attaches to an interior surface of said wall cavity.

9. The system of claim 8 wherein said plurality of annular rings are evenly spaced along a length of said rod of said male interlocking member.

10. The system of claim 8 further comprising:

a tapered joint connecting said female base plate and said tube extending perpendicularly from said female base plate wherein said tapered joint provides strength and stability to said wall repair apparatus; and a tapered joint connecting said male base plate and said rod extending perpendicularly from said male base plate wherein said tapered joint provides strength and stability to said wall repair apparatus.

11. The system of claim 8 wherein:

said female base plate is covered with an adhesive composition, at least one prong, at least one screw, or at least one nail to adhere said female base plate to a wall repair patch or a surface of an interior wall exposed to said wall cavity; and said male base plate is covered with an adhesive composition, at least one prong, at least one screw, or at least one nail to adhere said male base plate to a wall repair patch or a surface of an interior wall exposed to the said wall cavity.

12. The system of claim 11 wherein said adhesive composition is covered by a removable protective paper, wherein said removable protective paper is removed to expose said adhesive composition.

13. A wall repair method, said method comprising providing an adjustable wall repair apparatus to support a wall repair patch inserted into a hole in an existing wall, comprising:

utilizing a unitary one piece female interlocking member comprising a female base plate, wherein said female base plate has a first flat surface, a second flat surface, a first perimeter, and a hollow tube extending perpendicularly from said second flat surface wherein said first perimeter is greater than a diameter of said hollow tube; a unitary one piece adjustable male interlocking member comprising a male base plate, wherein said male base plate has a third flat surface, a fourth flat surface, a second perimeter, wherein said first perimeter and said second perimeter are a same size, and a rod extending perpendicularly from said third flat surface; and inserting and adjusting said male interlocking member within said female interlocking member to form a tension-fitted wall repair apparatus, wherein a plurality of spaced annular rings that surround and extend from said rod of said male interlocking member grip an interior surface of said female interlocking member via a tension fit wherein said wall is repaired when said repair apparatus attaches to said wall repair patch and a wall cavity, said patch is inserted into said hole in said existing wall, wherein said wall repair apparatus horizontally spans said wall cavity and permanently supporting a wall repair patch.

14. The method of claim 13 further comprising:

adhering said female base plate using an adhesive composition, at least one prong, at least one screw, or at least one nail, to either said wall repair patch or an interior surface of a wall facing said wall cavity; and adhering said male base plate using an adhesive composition, at least one prong, at least one screw, or at least one nail, to either said wall repair patch or said interior surface of said wall facing said wall cavity.

15. The method of claim 14 wherein said adhesive composition is covered by a removable protective paper, wherein said removable protective paper is removed to expose said adhesive composition.

16. The method of claim 13 further comprising:

adjusting said female interlocking member and said male interlocking member by pulling said rod of said male interlocking member from within said tube of said female interlocking member to expose at least one annular ring surrounding said rod of said male interlocking member to fit said wall repair apparatus within said wall cavity.

17. The method of claim 13 further comprising:

aligning said wall repair patch with said attached said wall repair apparatus with a wall surface to repair a damaged portion of said wall surface;

spackling around said wall repair patch;

sanding said spackling smooth around said wall repair patch when said spackle dries; and painting said wall repair patch to match said wall surface.

* * * * *